US008596899B2

(12) United States Patent
Braun et al.

(10) Patent No.: US 8,596,899 B2
(45) Date of Patent: Dec. 3, 2013

(54) DOWNHILL ENGAGEMENT AND MOTIVITY ADJUSTMENT

(75) Inventors: Robert Braun, Singhofen (DE); Thomas Quirein, Diez (DE)

(73) Assignee: Accuride International GmbH, Diez (DE)

( * ) Notice: Subject to any disclaimer, the term of this patent is extended or adjusted under 35 U.S.C. 154(b) by 110 days.

(21) Appl. No.: 12/991,972

(22) PCT Filed: May 13, 2009

(86) PCT No.: PCT/EP2009/055770

§ 371 (c)(1),
(2), (4) Date: Feb. 3, 2011

(87) PCT Pub. No.: WO2009/138427

PCT Pub. Date: Nov. 19, 2009

(65) Prior Publication Data

US 2011/0123258 A1 May 26, 2011

(30) Foreign Application Priority Data

May 13, 2008 (DE) ..... 10 2008 023 246

(51) Int. Cl.
*F16B 7/10* (2006.01)

(52) U.S. Cl.
USPC ..... 403/109.3; 312/330.1

(58) Field of Classification Search
USPC ..... 312/319.1, 333, 334.44, 334.45, 312/334.46; 384/21; 403/322.2, 321, 107, 403/108, 109.8, 109.3; 108/147.21
See application file for complete search history.

(56) References Cited

U.S. PATENT DOCUMENTS

| | | | | |
|---|---|---|---|---|
| 1,684,889 | A | 9/1928 | Russ | |
| 2,267,043 | A | 12/1941 | Promo | |
| 5,671,988 | A | 9/1997 | O'Neal | |
| 5,961,193 | A | 10/1999 | Hobbs | |
| 7,654,623 | B2 * | 2/2010 | Hsiung et al. | 312/333 |
| 2006/0163983 | A1 * | 7/2006 | Wu | 312/333 |
| 2007/0090735 | A1 | 4/2007 | Hashemi et al. | |
| 2007/0278920 | A1 * | 12/2007 | Chen | 312/334.44 |

FOREIGN PATENT DOCUMENTS

| | | | |
|---|---|---|---|
| DE | 20319598 | U1 | 5/2005 |
| DE | 202008000628 | U1 | 5/2008 |
| EP | 1522235 | A1 | 4/2005 |

* cited by examiner

*Primary Examiner* — Michael P Ferguson
*Assistant Examiner* — Daniel Wiley
(74) *Attorney, Agent, or Firm* — Paul & Paul

(57) ABSTRACT

An apparatus is provided for releasably locking two rail elements (10, 11), which are supported displaceably relative to each other, of a telescopic rail or a linear guide and for adjusting the motivity to be applied for the displacement, comprising a housing (1) which is fastened to a first one of the rail elements (11) which are supported displaceably relative to each other, at least one locking element (5) and at least one locking force spring (4) which is supported against the housing and biases the locking element (5) against the second of the rail elements (10) which are supported displaceably relative to each other, at least one friction element (7) and at least one friction force spring (6) which is supported against the housing and which presses the friction element (7) in biased relationship against the second of the rail elements (10) which are supported displaceably relative to each other.

11 Claims, 5 Drawing Sheets

DOWNHILL ENGAGEMENT AND MOTIVITY ADJUSTMENT

Figure 1:
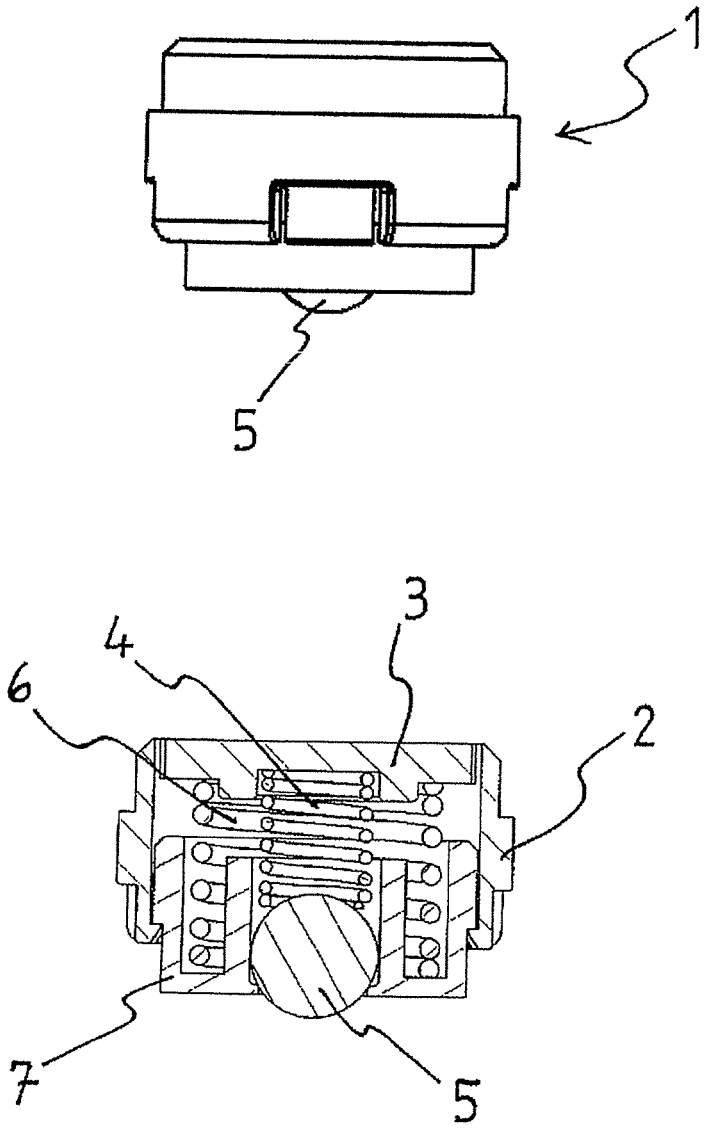

The invention concerns an apparatus for releasably locking two rail elements, which are supported displaceably relative to each other, of a telescopic rail or a linear guide, and for adjusting the motivity to be applied for the displacement.

A telescopic rail in accordance with the present application includes two or more rail elements which are supported displaceably relative to each other, wherein in the extended condition the telescopic rail is of a length which goes substantially beyond that of the longest rail element. In the case of a so-called partial extension device the telescopic rail can be extended to a length less than double the length of the longest rail element. In the case of a full extension device the telescopic rail can be extended to a length greater than double the length of the longest rail element. To implement a full extension device, at least three rail elements which are displaceable relative to each other are required. In the case of a linear guide a short rail element which is also referred to as a slider is guided along the length of a substantially longer rail element. The rail elements can be supported relative to each other by way of plain bearings, roller bearings or rolling bearings or by way of ball bearings. In more demanding applications, generally ball bearings are used, as they have a high load-bearing capability and good displacement properties.

For certain uses, it is required of telescopic rails and a linear guide that the linear movement can be locked in different displacement positions of the rail elements. In connection with this application the term 'lock'signifies that a greater force is opposed to the linear movement at a locking position than outside a locking position. In this connection locking does not signify that a latching action takes place in a given position, which would have to be released again by an unlocking mechanism. Locking in a given displacement position in accordance with the present application is to be releasable again by a somewhat increased application of force in the direction of pushing in or pulling out the telescopic rail or linear guide.

In addition, it is frequently required for telescopic rails and linear guides that the motivity to be applied for producing the displacement is adjustable. For many uses a telescopic rail or a linear guide is to be neither too easy nor too difficult to move. Excessively easy mobility can result in unintended displacement and can give the impression that the apparatus is overall less stable. Frequently the function and the touch of the telescopic rail or linear guide can be improved by an increase in the motivity to be applied for the displacement.

The lockability of the linear movement in different positions and the adjustability of the motivity forces are frequently to be embodied simultaneously in a telescopic rail or linear guide. Hitherto two independent systems are required for that purpose. They comprise many individual parts and have to be assembled separately. In general those systems are only designed and can be used for a given type of telescopic rails or linear guides. Disadvantages of the systems which hitherto are separate for the two desired functions are that they consist of many individual parts and are thus complicated and expensive to manufacture and assemble and are therefore also susceptible to trouble. In addition they require a relatively large amount of space.

The object of the present invention is therefore that of providing an apparatus for releasably locking two rail elements, which are supported displaceably relative to each other, of a telescopic rail or a linear guide and for adjusting the motivity to be applied for the displacement, which is improved in relation to the state of the art and which in particular provides both functions in one component, requires less space, can be used in different rail systems, is simple and inexpensive to manufacture and assemble, and allows the forces for locking and for movement to be established independently of each other.

That object is attained by an apparatus of the kind set forth in the opening part of this specification comprising a housing which is fastened to a first one of the rail elements which are supported displaceably relative to each other, at least one locking element and at least one locking force spring which is supported against the housing and biases the locking element against the second of the rail elements which are supported displaceably relative to each other, at least one friction element and at least one friction force spring which is supported against the housing and which presses the friction element in biased relationship against the second of the rail elements which are supported displaceably relative to each other.

The housing of the apparatus according to the invention desirably comprises metal or plastic, wherein the housing preferably comprises plastic as in that way it can be easily and inexpensively manufactured in an injection molding process or another shaping process for plastic parts. The housing can be fastened in various ways to the first of the rail elements which are supported displaceably relative to each other, for example by screwing thereto or by means of a clipping or latching mechanism. For fastening the housing of the apparatus according to the invention the rail element desirably has an opening which passes through the rail element and into which the housing is inserted and fastened. The provision of a through opening on the first rail element for fastening the housing is desirable as the apparatus must engage therethrough as far as the oppositely disposed second rail element where the friction element and the locking element come into contact with the second of the rail elements which are supported displaceably relative to each other. It would also be conceivable for the housing of the apparatus according to the invention to be fastened to the inside of the first rail element, that is towards the second rail element. It will be noted however that this would require a relatively large intermediate space between the rail elements which are displaceable relative to each other in order to dispose therein the housing, the two spring elements as well as the locking element and the friction element. In the preferred variant therefore the apparatus according to the invention engages through an opening in the first of the two rail elements which are supported displaceably relative to each other.

The apparatus according to the invention includes at least two spring elements, namely at least a locking force spring which biases the locking element against the second of the rail elements which are supported displaceably relative to each other and a friction force spring which presses the friction element in biased relationship against the second of the rail elements which are supported displaceably relative to each other.

The locking element is so designed that it can come into engagement with locking openings on the second rail element for releasable locking of the two rail elements which are supported displaceably relative to each other, when upon displacement of the rail elements it comes to lie over a locking opening. Desirably the locking opening on the second rail element is a recess or a bore into which the locking element can penetrate by a distance.

The locking element is to be caused to come out of engagement again with the locking opening by the application of a force which is increased in relation to the normal motivity so that the displacement movement can be continued. For that purpose it is desirable if there are provided on the locking element and/or the locking openings, in both the directions of displacement, rounded portions or inclined portions for movement of the locking element into and out of the locking opening. In an embodiment of the invention the locking element is a ball which is pressed in biased relationship by the locking force spring against the second of the rail elements which are supported displaceably relative to each other. The locking openings can then be for example circular bores of a diameter less than that of the locking element in ball form. When the locking element in ball form is guided over the locking opening upon linear displacement of the rail elements, the ball passes under the biasing force of the locking force spring into the locking opening by a distance and the displacement movement is blocked or in accordance with the present application releasably locked.

To move the locking element, preferably the locking element in ball form, out of the locking opening and to disengage it in order to release the locking action and continue the linear movement of the rail elements, an increased force has to be applied to the rail elements in the displacement direction, the magnitude of that force depending inter alia on the strength of the locking force spring. It will be appreciated that the shape and size of the locking element as well as the shape and size of the locking opening play a part in regard to the forces involved when releasing the locking action.

The locking force spring and the friction force spring are spring elements which are independent of each other and which are both supported on the housing of the apparatus according to the invention. In an embodiment of the invention the housing has a preferably cylindrical housing wall and on the side remote from the second rail element a housing cover, against which the at least one locking force spring and the at least one friction force spring bear. That housing cover can be fixedly and possibly integrally connected to the cylindrical housing wall so that the housing is of a substantially cup-shaped configuration. Alternatively the housing cover is in the form of a separate part which can be releasably fastened to the cylindrical housing wall for example by screwing or clipping in order if required to be able to open the housing on the side of the housing cover.

In a further embodiment of the invention provided on the housing are means for altering the length of the locking force spring between the support point on the housing and the locking element. The locking force of the locking force spring can be adjusted by altering the length thereof. One means for altering the length of the locking force spring may for example provide that the position of the support point of the locking force spring on the housing can be altered by a screwthread. Such means for altering the length of the locking force spring on the housing have the advantage that the locking force can also be subsequently altered. Otherwise the locking force is predetermined by the locking force spring used and its initial compression.

In a further embodiment there are also provided on the housing means for altering the length of the friction force spring between the support point on the housing and the friction element for displacement of the friction force of the friction force spring. The configuration can correspond to that of the means for altering the length of the locking force spring. The apparatus according to the invention may have the means for altering the locking force spring alone or the means for altering the length of the friction force spring alone. Alternatively the apparatus according to the invention may have both means for altering the length of the locking force spring and also the friction force spring, in which case the lengths of the springs can be adjustable separately and independently of each other or jointly.

In a preferred embodiment of the invention the at least one locking force spring and/or the at least one friction force spring are in the form of coil compression springs. Other kinds of compression spring elements can also be used and are not excluded from the scope of the present invention. Other kinds of spring elements are for example gas compression springs or oil compression springs. It will be noted however that coil compression springs are preferred for use in the apparatus according to the invention as they are considerably less expensive and have better spring characteristics for use in the present invention.

In a further preferred embodiment of the invention the at least one locking force spring and the at least one friction force spring are in the form of coil springs of different diameters and are arranged coaxially relative to each other in the direction of their spring force. In this embodiment preferably the locking force spring is the spring element of the smaller diameter and the friction force spring is that of the larger diameter so that the locking force spring extends coaxially in the interior of the friction force spring.

In a further embodiment, preferably an embodiment in which the locking force spring and the friction force spring are arranged in mutually coaxial relationship, the friction element is a substantially cup-shaped or cylindrical element having a cylindrical outside wall and on the side towards the second rail element an annular floor extending inwardly from the edge of the cylindrical outside wall, wherein an end portion of the friction force spring extends within the cylindrical outside wall and is supported against the annular floor in order to press the friction element in a biased relationship against the second of the rail elements which are supported displaceably relative to each other. The annular floor has a through opening, through which the locking element partially passes.

When the locking element, as described hereinbefore, is of a substantially ball-shaped configuration, then the through opening in the annular floor of the friction element is appropriately a round opening. Preferably that opening is of a diameter which is at least slightly smaller than the diameter of the ball-shaped locking element so that then a segment of the ball-shaped locking element can pass in the direction of the second rail element and for example into a locking opening through the annular floor of the friction element, but is prevented from dropping out by virtue of the somewhat smaller diameter of the through opening.

Upon displacement of the rail elements relative to each other the floor of the friction element rubs under the biasing force of the friction force spring against the inside of the second of the rail elements which are supported displaceably relative to each other and thereby inhibits the movement or increases the motivity to be applied to cause the displacement.

With regard to the friction element and the friction force spring the motivity to be applied for the displacement or the frictional resistance is determined on the one hand by the force of the friction force spring and on the other hand by the shape, size and roughness of the region of the friction element, that bears against the second rail element. It will be appreciated that still other factors influence the motivity to be applied for displacement of the rail elements such as for example the size of the rail elements, the support mounting between the rail elements and the load applied to the rail elements. In relation to the apparatus according to the invention it is to be borne in mind that in the displacement of the rail elements the locking element which is biased under the force of the locking force spring is also pressed in biased relationship against the second of the rail elements and the motivity to be applied is thus increased.

In a further embodiment the above-described friction element which has the cylindrical outside wall and the substantially annular floor has a further cylindrical wall which extends from the edge of the through opening in the annular floor coaxially relative to the cylindrical outside wall, wherein an end portion of the friction force spring extends between the cylindrical outside wall and the further cylindrical wall and an end portion of the friction force spring extends within the further cylindrical wall. That additional cylindrical wall stabilises the structure of the friction element and the position of the friction force spring in contact with the friction element. In addition that additional annular wall is suitable for guiding the locking force spring extending within that wall and the locking element arranged at the end of the locking force spring and for preventing it from tipping or being tilted, with a loss in terms of its functional capability.

In a further preferred embodiment of the apparatus according to the invention with a friction element having a cylindrical outside wall the friction element is inserted in positively locking relationship into the substantially cylindrical housing wall, wherein the friction element can be pressed into the housing against the force of the friction force spring but is preferably secured to prevent it from dropping out of the housing. The friction element is secured to prevent it from dropping out of the housing in a preferred embodiment in that provided on the cylindrical outside wall of the friction element on the outside is a peripherally extending ridge or at least portions thereof and hooks engaging around said ridge from the outside are provided on the cylindrical housing wall.

Besides the apparatus previously described herein the present invention also embraces telescopic rails and linear guides having at least two rail elements which are supported displaceably relative to each other and an apparatus of the kind described herein for releasably locking the rail elements and for adjusting the motivity to be applied for the displacement.

Telescopic rails and linear guides of higher quality are generally supported by ball bearings, wherein the balls are held at a uniform spacing relative to each other by means of a ball cage between the rail elements and are secured to prevent them from dropping out and to prevent unwanted displacement. The conventional telescopic rails and linear guides have rail elements of a substantially C-shaped profile, wherein the runner tracks for the balls are provided on the limbs or end portions of the C-shaped profiles. Each rail element thus has two mutually opposite runner tracks. The ball cage generally extends between those runner tracks for stability reasons so that there is a ball cage for both runner tracks. The connecting portion of the ball cage between the two runner tracks extends between the two rail elements which are displaceable relative to each other. Therefore, upon displacement of the rail elements relative to each other the ball cage does not get in the way of the locking elements and the friction element of the present invention. In the case of ball-supported telescopic rails and linear guides with ball cage according to the invention therefore the ball cage desirably has a through opening which extends in the longitudinal direction and through which at least the friction element and the locking element pass relative to the second of the rail elements which are supported displaceably relative to each other.

The apparatus according to the invention has the advantage that it combines the two functions of releasable locking of two rail elements which are supported displaceably relative to each other and adjustment of the motivity to be applied for the displacement, in one component. Nonetheless the locking force and the motivity can be established independently of each other, more specifically by way of the respective spring elements used as well as the locking and friction elements. In comparison with the known systems the apparatus according to the invention requires only little space and can be used without modifications in very many different types of telescopic rails and linear guides. It is inexpensive to manufacture and install due to the simplicity of the components and the ease of assembly. As the system is permanently under stress the play between the components can be compensated so that nonetheless higher tolerances are possible. Changes in the components due to temperature fluctuations are also compensated by the biasing effect in the system.

Further advantages, features and possible configurations are described by means of the example hereinafter and the related FIGS.

Figure 2:
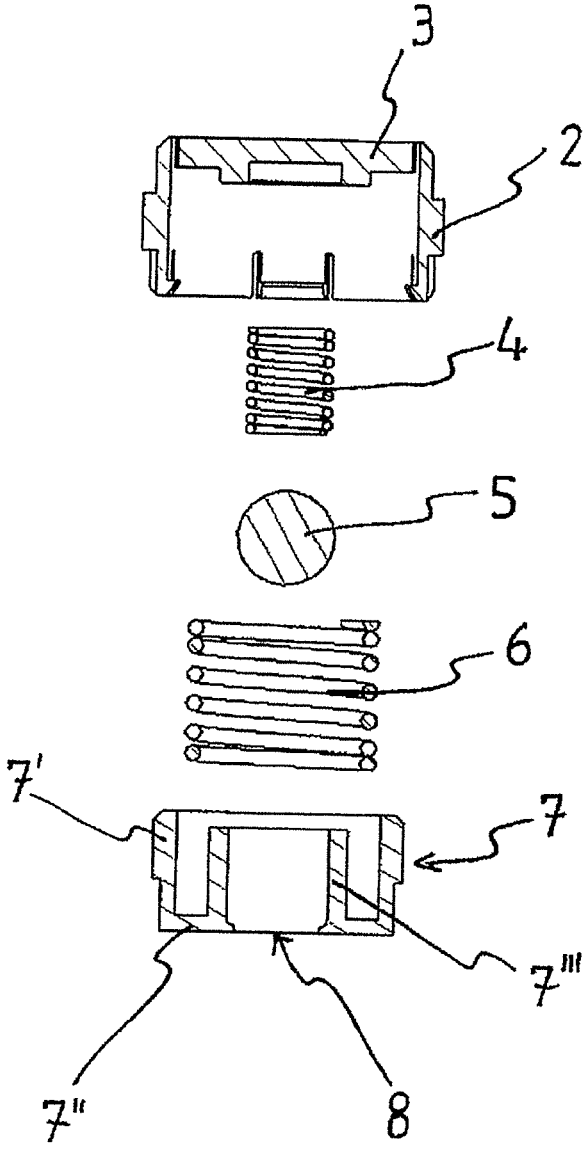
Figure 3:
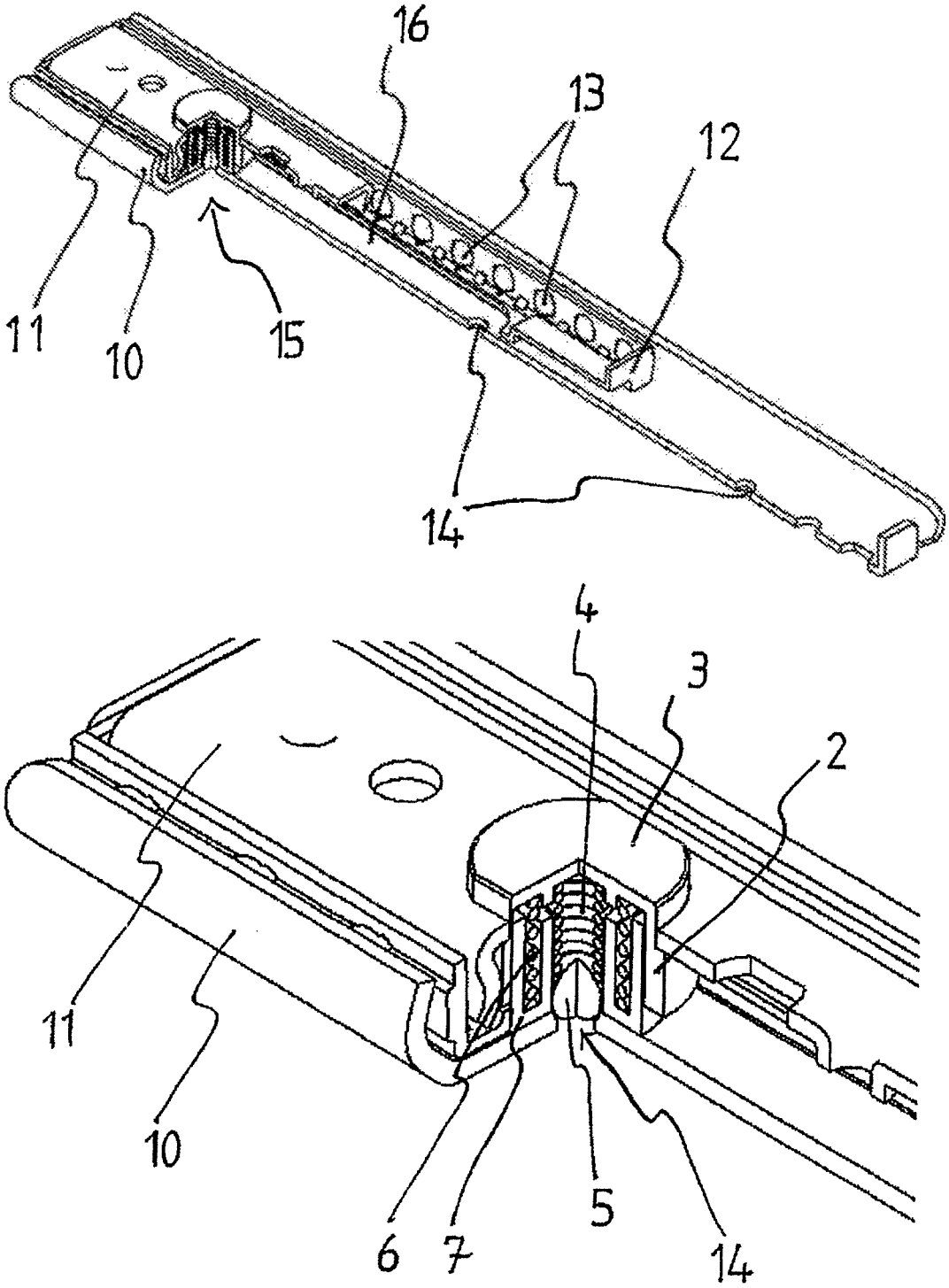
Figure 4:
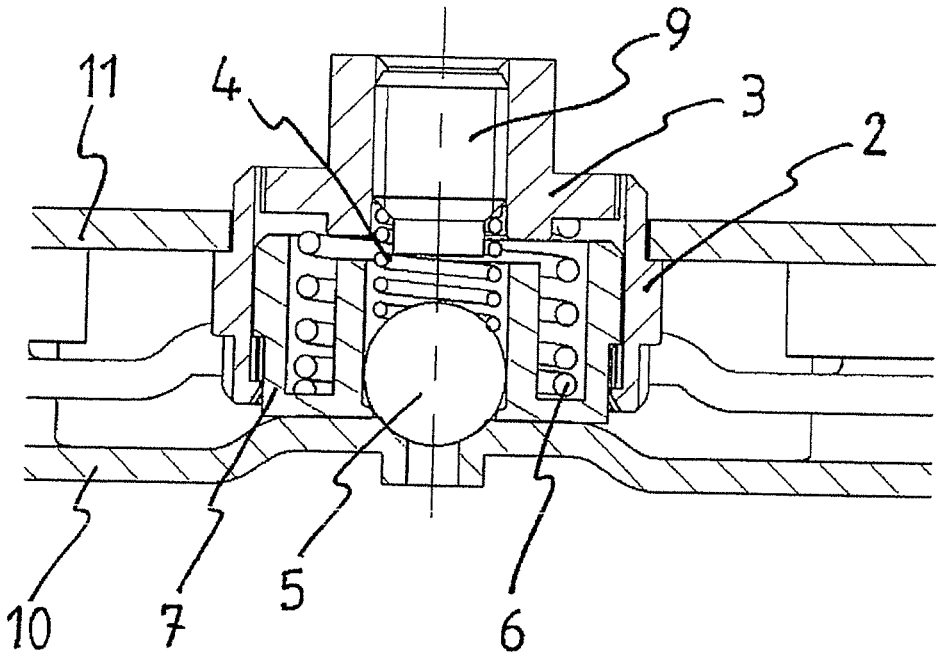
Figure 4:
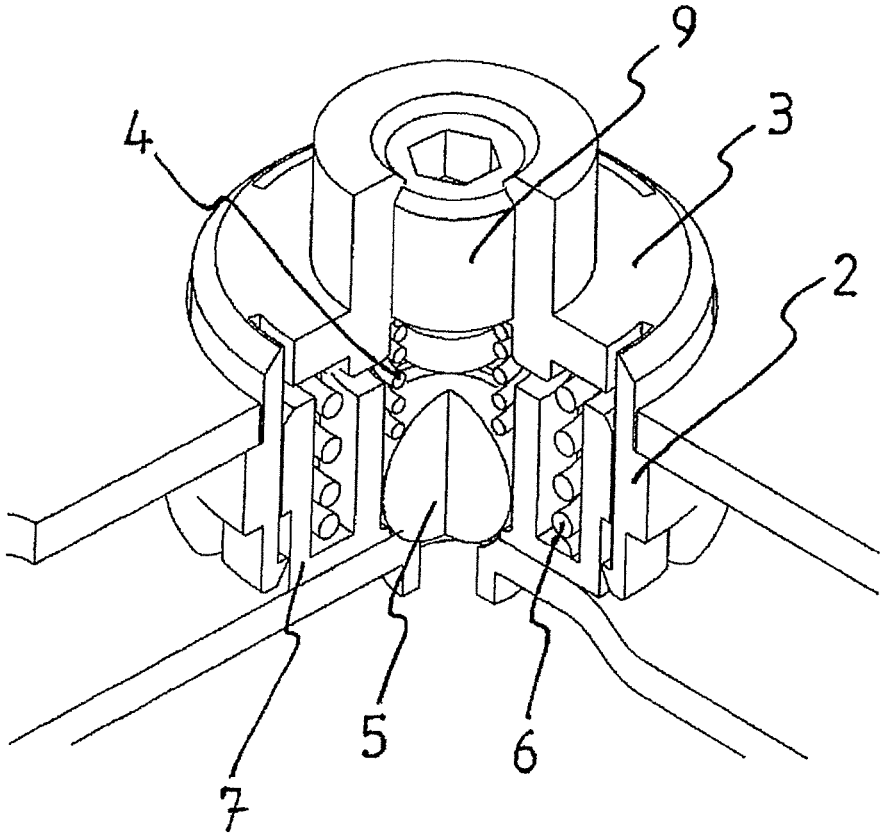

FIG. 1 shows an apparatus according to the invention for releasable locking of two rail elements, that are displaceable relative to each other, of a telescopic rail or a linear guide and for adjusting the motivity to be applied for the displacement from the side (upper view) and in cross-section (lower view), FIG. 2 shows a cross-sectional exploded view of the individual parts of the apparatus of FIG. 1, FIG. 3 shows a ball-mounted telescopic rail as a broken-away perspective view with installed apparatus according to the invention as shown in FIG. 1, and FIG. 4 shows an alternative embodiment of the apparatus according to the invention for releasable locking of two rail elements, that are displaceable relative to each other, of a telescopic rail or a linear guide and for adjusting the motivity to be applied for the displacement, with apparatuses for adjusting the locking force and the friction force in cross-section from the side (upper view) and as a broken-away perspective view (lower view).

Figure 4A:
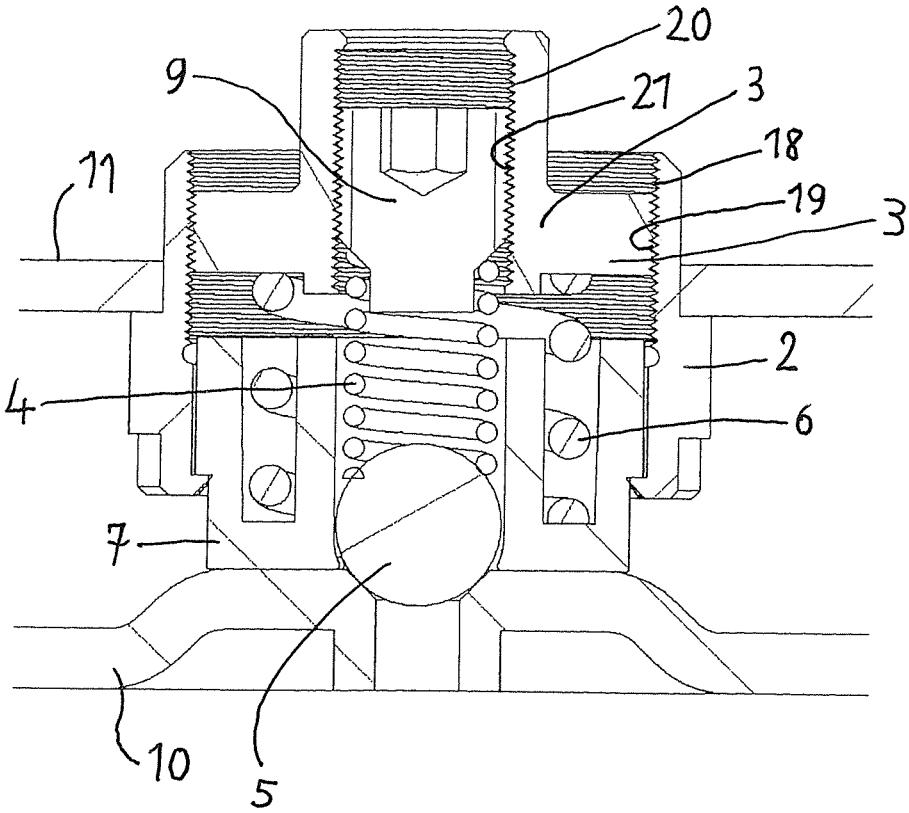
Figure 4A:
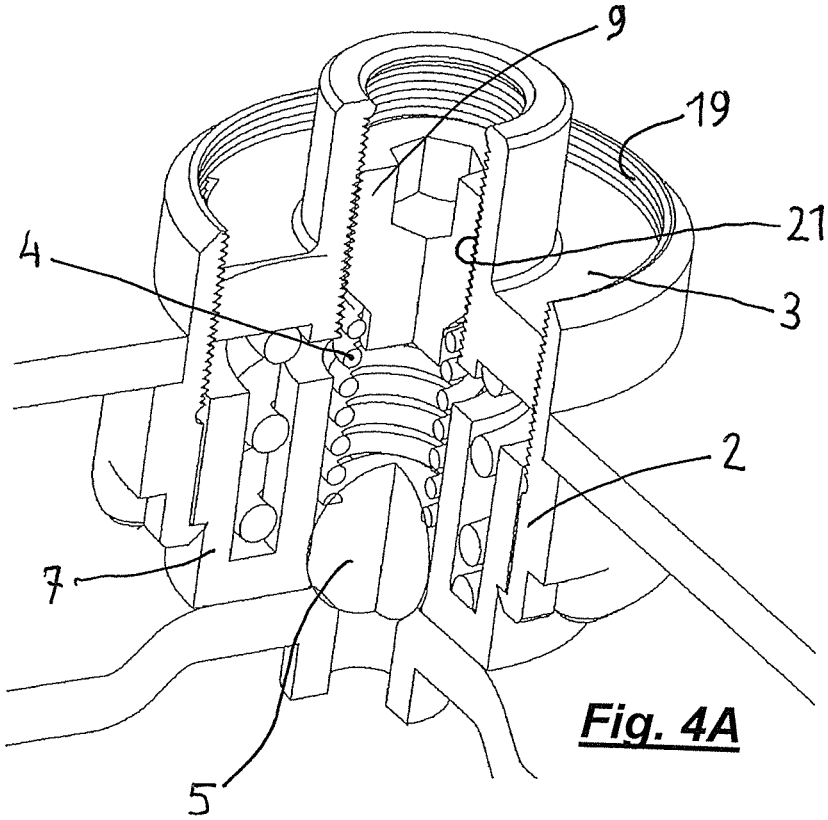

FIG. 4A shows substantially the embodiment of FIG. 4, wherein male and female screw threads are illustrated to adjusting locking and frictional forces.

FIGS. 1 and 2 show an apparatus according to the invention for releasable locking of two rail elements, that are supported displaceably relative to each other, of a telescopic rail or a linear guide and for adjusting the motivity to be applied for the displacement as a view from the side (top in FIG. 1), in cross-section (bottom in FIG. 1) and as a cross-sectional exploded view broken down into the individual parts (FIG. 2). The apparatus includes a housing 1 having a substantially cylindrical housing wall 2 and a housing cover 3 which is in the form of a separate component but which is fitted on the housing wall 2. The parts of the housing are produced from plastic using an injection molding process.

The apparatus further includes a locking force spring 4 and a friction force spring 6 which are both made from metal in the form of coil compression springs of differing diameter. The locking force spring 4 of the smaller diameter extends coaxially within the friction force spring 6 of the larger diameter. Both springs 4 and 6 are supported upwardly against the housing cover. In this variant means for subsequently altering the support position of the springs for fine adjustment of the spring forces are not provided but can be implemented in the described fashion. For example the housing cover 3 could be screwed into and/or out of the housing outside wall 2 with a screwthread in order to be able to subsequently adjust the spring lengths to a limited extent.

Provided at the end of the springs, opposite to the housing cover 3, is a friction element 7 which is held by the friction force spring 6 in a biased condition downwardly in FIGS. 1 and 2. The friction element 7 comprises a cylindrical outside wall 7' and an annular floor 7" which extends from the lower edge of the cylindrical outside wall 7' towards the center. Provided in the annular floor 7" is a through opening 8 through which the locking element 5 in ball form partially passes. Extending upwardly from the inner edge of the annular floor 7" or from the through opening 8 is a further cylindrical wall 7'", in the interior of which the locking force spring 4 and the locking element 5 partially extend. That further cylindrical wall 7'" is suitable for guiding the locking element 5 in ball form. The through opening 8 in the annular floor 7" is of a slightly smaller diameter than the locking element 5 in ball form so that the ball 5 is urged biased by the locking force spring 4 downwardly and against the edge of the through opening 8 without the ball 5 being able to drop out.

At the cylindrical outside wall 7' the friction element 7 has a peripherally extending ridge or a widened portion which is embraced by locking hooks on the housing outside wall 2 so that the friction element 7 is held in the cylindrical housing outside wall 2 and can be pressed into the housing against the spring biasing forces, but does not fall out of the housing.

FIG. 3 shows a ball-supported telescopic rail comprising an outer rail 10 and an inner rail 11 which both are of a substantially C-shaped profile, wherein the runner tracks for the ball bearing mounting are respectively arranged on the limbs or end portions of the C-shaped profile. The ball bearing arranged between the rail elements 10 and 11 includes a ball cage 12 and two sets of balls 13 arranged on opposite sides of the rail elements.

The inner rail 11 has a receiving opening 15 into which the apparatus according to the invention as shown in FIGS. 1 and 2 is inserted. The lower view in FIG. 3 shows a detail view on an enlarged scale of the rail portion of the upper view in FIG. 3, at which the apparatus according to the invention is inserted. It can be clearly seen that the friction element 7 bears in a biased condition with the smooth surface of the annular floor 7" against the inside of the outer rail 10 and there exercises a frictional force. Provided on the outer rail 10 at a plurality of positions are locking openings 14 in the form of circular through bores. As can be clearly seen in the lower part of FIG. 3 the locking element 5 in ball form passes into such a locking opening 14 when the locking element 5 comes to lie over the locking opening 14 in the displacement of the rail elements.

The ball cage 12 shown in FIG. 3 consists of one piece, that is to say between the two mutually opposite ball runner tracks it has connecting portions which extend between the rail elements 10 and 11. So that the apparatus according to the invention which is mounted to the inner rail 11 can come into contact with the locking element 5 and the friction element 7 with the inside surface of the outer rail 10 and the ball cage is not in the way in the displacement of the rail elements, the ball cage 12 has a through opening which extends in the longitudinal direction and which is so arranged that the apparatus according to the invention can be displaced therebetween.

The embodiment of the apparatus according to the invention as shown in FIG. 4A substantially corresponds to that shown in FIGS. 1,2 and 4 with the difference that provided on the housing cover 3 are means for altering the length of the locking force spring 4 between the support point on the housing and the locking element 5 and means for altering the length of the friction force spring 6 between the support point on the housing and the friction element 7. The means for altering the length and thus the spring force of the friction force spring 6 provide that the housing cover 3 can be screwed in and out within certain ranges with a male screwthread 18 provided at the edge within the housing outside wall 2 which is provided with a corresponding female screwthread 19, whereby the length of the friction force spring is altered. The means for altering the locking force spring 4 provide that in the housing cover 3 the support for the locking force spring 4 is a substantially cylindrical part 9 having a male screwthread 20 which can be screwed into and out of a cylindrical portion of the housing cover 3, that is provided with a corresponding female screwthread 21, whereby the length of the locking force spring 4 is increased or reduced. The two means for altering the length of the locking force spring 4 and the friction force spring make it possible to subsequently finely adjust the respective locking and frictional forces after mounting of the apparatus according to the invention on a telescopic rail or a linear guide.

List of References

1 housing
2 housing outside wall
3 housing cover
4 locking force spring
5 locking element
6 friction force spring
7 friction element
7' cylindrical outside wall of the friction element
7" annular floor of the friction element
7'" further cylindrical wall of the friction element
8 through opening in the floor
9 means for altering the length of the locking force spring
10 outer rail
11 inner rail
12 ball cage
13 balls
14 locking openings on the outer rail
15 receiving opening on the inner rail for housing assembly
16 through opening in the ball cage

The invention claimed is:

1. An apparatus adapted to be fastened to rail elements for releasably locking two rail elements (10, 11), which are supported displaceably relative to each other, of a telescopic rail or a linear guide and for adjusting the motivity to be applied for the displacement, comprising a housing (1) which is adapted to be fastened to a first one of the rail elements (11) which are supported displaceably relative to each other, at least one locking element (5) and at least one locking force spring (4) which is supported against the housing and being adapted to bias the locking element (5) against the second of the rail elements (10) which are supported displaceably relative to each other, at least one friction element (7) and at least one friction force spring (6) which is supported against the housing and which is adapted to press the friction element (7) in biased relationship against the second of the rail elements (10) which are supported displaceably relative to each other, wherein the at least one locking force spring (4) and the at least one friction force spring (6) are in the form of coil springs of differing diameters and are coaxially aligned.

2. The apparatus as set forth in claim 1 characterised in that the at least one locking element (5) is a ball which is adapted to be pressed in a biased relationship by the locking force spring (4) against the second of the rail elements (10) which are supported displaceably relative to each other.

3. The apparatus as set forth in claim 1 characterised in that the housing (1) has a cylindrical housing wall (2) and on the side adapted to be remote from the second rail element (10) a housing cover (3) at which the at least one locking force spring (4) and the at least one friction force spring (6) are supported.

4. The apparatus as set forth in claim 1 characterised in that the at least one locking force spring (4) and/or the at least one friction force spring (6) are in the form of coil compression springs.

5. The apparatus as set forth in claim 1 characterised in that the friction element (7) has a cylindrical outside wall and on a side thereof which is adapted to press the friction element (7) in biased relationship against the second of the rail elements (10) an annular floor which extends inwardly from an edge of the cylindrical outside wall, wherein an end portion of the locking force spring (6) extends within the cylindrical outside wall and is supported at the annular floor to press the friction element (7) in biased relationship against the second of the rail elements (10) which are supported displaceably relative to each other, and the annular floor further has a through opening through which the locking element (5) partially passes.

6. The apparatus as set forth in claim 5 characterised in that the friction element (7) has a further cylindrical wall which extends from an edge of the through opening in the annular floor coaxially with respect to the cylindrical outside wall, wherein an end portion of the friction force spring (6) extends between the cylindrical outside wall and the further cylindrical wall and an end portion of the locking force spring (4) extends within the further cylindrical wall.

7. The apparatus as set forth in claim 1 characterised in that provided on the housing (1) are means for altering the length of the locking force spring (4) between a support point on the housing (1) and the locking element (5) for adjustment of the force of the locking force spring (4).

8. The apparatus as set forth in claim 1 characterised in that provided on the housing (1) are means for altering the length of the friction force spring (6) between the support point on the housing (1) and the friction element (7) for adjustment of the force of the friction force spring (6).

9. A telescopic rail or linear guide comprising at least two rail elements (10, 11) which are supported displaceably relative to each other and an apparatus as set forth in one of the preceding claims 1-2 for releasably locking the rail elements and for adjusting the motivity to be applied for the displacement.

10. The telescopic rail or linear guide as set forth in claim 9 characterised in that the at least two rail elements (10, 11) are supported displaceably relative to each other by way of a ball bearing having a ball cage (12) and balls (13), wherein the ball cage (12) has a through opening (16) which extends in the longitudinal direction and through which at least the friction element (7) and the locking element (5) pass relative to the second of the two rail elements (10) which are supported displaceably relative to each other.

11. The telescopic rail or linear guide as set forth in claim 9 characterised in that provided in the second of the rail elements (10) which are supported displaceably relative to each other are locking openings (14) which are of such a configuration that the locking element (5) is in engagement therewith when it comes to lie over a locking opening (14) upon displacement of the rail elements (10, 11) relative to each other.

* * * * *